US009683432B2

(12) United States Patent
Fordyce et al.

(10) Patent No.: US 9,683,432 B2
(45) Date of Patent: Jun. 20, 2017

(54) HYBRID LPG FRAC

(71) Applicant: GasFrac Energy Services Inc., Calgary (CA)

(72) Inventors: Victor Fordyce, Red Deer (CA); Eric Tudor, Katy, TX (US)

(73) Assignee: Step Energy Services LLC, Dover, DE (US)

( * ) Notice: Subject to any disclaimer, the term of this patent is extended or adjusted under 35 U.S.C. 154(b) by 0 days.

(21) Appl. No.: 13/894,278

(22) Filed: May 14, 2013

(65) Prior Publication Data

US 2013/0299167 A1 Nov. 14, 2013

Related U.S. Application Data

(60) Provisional application No. 61/646,657, filed on May 14, 2012, provisional application No. 61/780,813, filed on Mar. 13, 2013.

(51) Int. Cl.
*E21B 43/16* (2006.01)
*E21B 43/26* (2006.01)
*E21B 43/267* (2006.01)

(52) U.S. Cl.
CPC ..... *E21B 43/26* (2013.01); *E21B 43/267* (2013.01)

(58) Field of Classification Search
CPC ..... E21B 43/16; F04B 15/023; F04B 2015/02
(Continued)

(56) References Cited

U.S. PATENT DOCUMENTS 2,876,839 A * 3/1959 Fast ..... C09K 8/64 166/283
3,378,074 A 4/1968 Kiel
(Continued)

FOREIGN PATENT DOCUMENTS

AU 775517 8/2004
AU 2004203288 A1 8/2005
(Continued)

OTHER PUBLICATIONS

"Material Safety Data Sheet: Mixed B-B's (Butane/Butylene)," Valero, Nov. 13, 2012, 9 pages.
(Continued)

*Primary Examiner* — Angela M DiTrani
*Assistant Examiner* — Ashish Varma
(74) *Attorney, Agent, or Firm* — Christensen O'Connor Johnson Kindness PLLC

(57) ABSTRACT

A fracturing method comprises: pumping a first stream of liquefied petroleum gas and gelling agent with a first frac pressure pump; pumping a second stream of lubricated proppant with a second frac pressure pump; combining the first stream and the second stream within a wellhead into a combined stream; pumping the combined stream into a hydrocarbon reservoir; and subjecting the combined stream in the hydrocarbon reservoir to fracturing pressures. A fracturing apparatus comprises: a first frac pressure pump connected to a first port of a wellhead; a second frac pressure pump connected to a second port of the wellhead; a frac fluid source connected to simply a stream of frac fluid comprising liquefied petroleum gas to the first frac pressure pump; a gel source connected to supply a gelling agent into the frac fluid; and a proppant supply source connected to supply lubricated proppant to the second frac pressure pump.

14 Claims, 6 Drawing Sheets

(58) Field of Classification Search
USPC ..... 166/280.1
See application file for complete search history.

(56) References Cited

U.S. PATENT DOCUMENTS

| | | | | |
|---|---|---|---|---|
| 3,664,422 | A | 5/1972 | Bullen | |
| 3,842,910 | A | 10/1974 | Zingg | |
| 3,846,310 | A | 11/1974 | Blackwell | |
| 4,176,064 | A | 11/1979 | Black | |
| 4,448,709 | A | 5/1984 | Bullen | |
| 4,512,405 | A | 4/1985 | Sweatman | |
| 4,569,394 | A | 2/1986 | Sweatman | |
| 4,577,691 | A * | 3/1986 | Huang | E21B 43/24 166/272.3 |
| 5,164,099 | A * | 11/1992 | Gupta | C09K 8/62 166/300 |
| 5,799,734 | A | 9/1998 | Norman | |
| 5,899,272 | A | 5/1999 | Loree | |
| 6,439,310 | B1 | 8/2002 | Scott, III | |
| 6,511,944 | B2 | 1/2003 | Taylor | |
| 6,544,934 | B2 | 4/2003 | Taylor | |
| 7,066,262 | B2 | 6/2006 | Funkhouser | |
| 7,163,060 | B2 | 1/2007 | Weiss | |
| 7,168,490 | B2 | 1/2007 | Taylor | |
| 7,213,641 | B2 * | 5/2007 | McGuire | E21B 43/26 166/177.5 |
| 7,293,611 | B2 | 11/2007 | Taylor | |
| 7,314,850 | B2 | 1/2008 | Taylor | |
| 7,328,744 | B2 | 2/2008 | Taylor | |
| 7,341,103 | B2 | 3/2008 | Taylor | |
| 7,341,106 | B2 | 3/2008 | Reddy | |
| 7,451,820 | B2 | 11/2008 | Albers | |
| 7,845,413 | B2 | 12/2010 | Shampine | |
| 8,006,760 | B2 | 8/2011 | Fleming | |
| 8,056,635 | B2 | 11/2011 | Shampine | |
| 8,119,575 | B2 | 2/2012 | Taylor | |
| 8,276,659 | B2 | 10/2012 | Fordyce | |
| 2005/0056428 | A1 | 3/2005 | Jeffrey, Jr. | |
| 2005/0189112 | A1 | 9/2005 | Taylor | |
| 2006/0065400 | A1 | 3/2006 | Smith | |
| 2007/0204991 | A1 | 9/2007 | Loree | |
| 2008/0029267 | A1 | 2/2008 | Shampine | |
| 2008/0264641 | A1 | 10/2008 | Slabaugh | |
| 2009/0301719 | A1 * | 12/2009 | Bull | C09K 8/64 166/280.2 |
| 2009/0301725 | A1 | 12/2009 | Case | |
| 2010/0051272 | A1 * | 3/2010 | Loree | E21B 43/26 166/279 |
| 2012/0006550 | A1 | 1/2012 | Shampine | |
| 2013/0255953 | A1 | 10/2013 | Tudor | |

FOREIGN PATENT DOCUMENTS

| | | | |
|---|---|---|---|
| AU | 2008244061 | A1 | 11/2008 |
| AU | 2008255243 | A1 | 8/2009 |
| AU | 2009248462 | A1 | 1/2010 |
| CA | 1 215 640 | A | 12/1986 |
| CA | 1 220 412 | A | 4/1987 |
| CA | 2 372 329 | A1 | 8/2002 |
| CA | 2 372 857 | A1 | 8/2002 |
| CA | 2 557 381 | A1 | 9/2005 |
| CA | 2 557 413 | A1 | 9/2005 |
| CA | 2 557 459 | A1 | 9/2005 |
| CA | 2 644 169 | A1 | 9/2005 |
| CA | 2 514 140 | A1 | 2/2006 |
| CA | 2 681 356 | A1 | 11/2008 |
| CA | 2 649 275 | A1 | 7/2009 |
| DE | 1 253 211 | | 11/1967 |
| EP | 0 313 243 | A2 | 4/1989 |
| EP | 0 695 852 | A2 | 2/1996 |
| EP | 1 234 948 | A1 | 8/2002 |
| EP | 1 236 863 | A1 | 9/2002 |
| EP | 2/139/592 | | 1/2010 |
| RU | 2 166 079 | C1 | 4/2001 |
| RU | 2 183 739 | C2 | 6/2002 |
| RU | 2 257 465 | C2 | 4/2005 |
| RU | 2006 134 038 | A | 4/2008 |
| WO | 2008/132440 | A2 | 11/2008 |
| WO | 2009/147394 | A1 | 12/2009 |
| WO | 2010/139938 | A2 | 12/2010 |
| WO | 2011/150486 | A1 | 12/2011 |

OTHER PUBLICATIONS

US Environmental Protection Agency, "Permitting Guidance for Oil and Gas Hydraulic Fracturing Activities Using Diesel Fuels—Draft: Underground Injection Control Program Guidance #84," May 2012, 54 pages.

Hurst R.E., "Designing Successful Gas Frac Treatments," Petroleum Engineer 45:7, pp. 67, 70, 72, 76, Jul. 1972.

Hurst, R.E., "Use of Liquified Gases as Fracture Fluids for Dry Gas Reservoirs," Society of Petroleum Engineers, Jan. 1972, 13 pages.

Enform, "Pumping of Flammable Fluids," Drilling and Completion Committee, Mar. 2009, 91 pages.

Frac Solutions Ltd., "TSO 9000 Series," Terroco Oilfield Services, Red Deer, Alberta, Apr. 2009, 2 pages.

Stinger, "Buffalo Heads," Wellhead Protection (Canada) Inc., Red Deer, Alberta, Apr. 2012, 1 page.

"Hydrocarbon Liquid Analysis," Core Lab for Synoil Energy Services, Sep. 2011, 1 page.

* cited by examiner

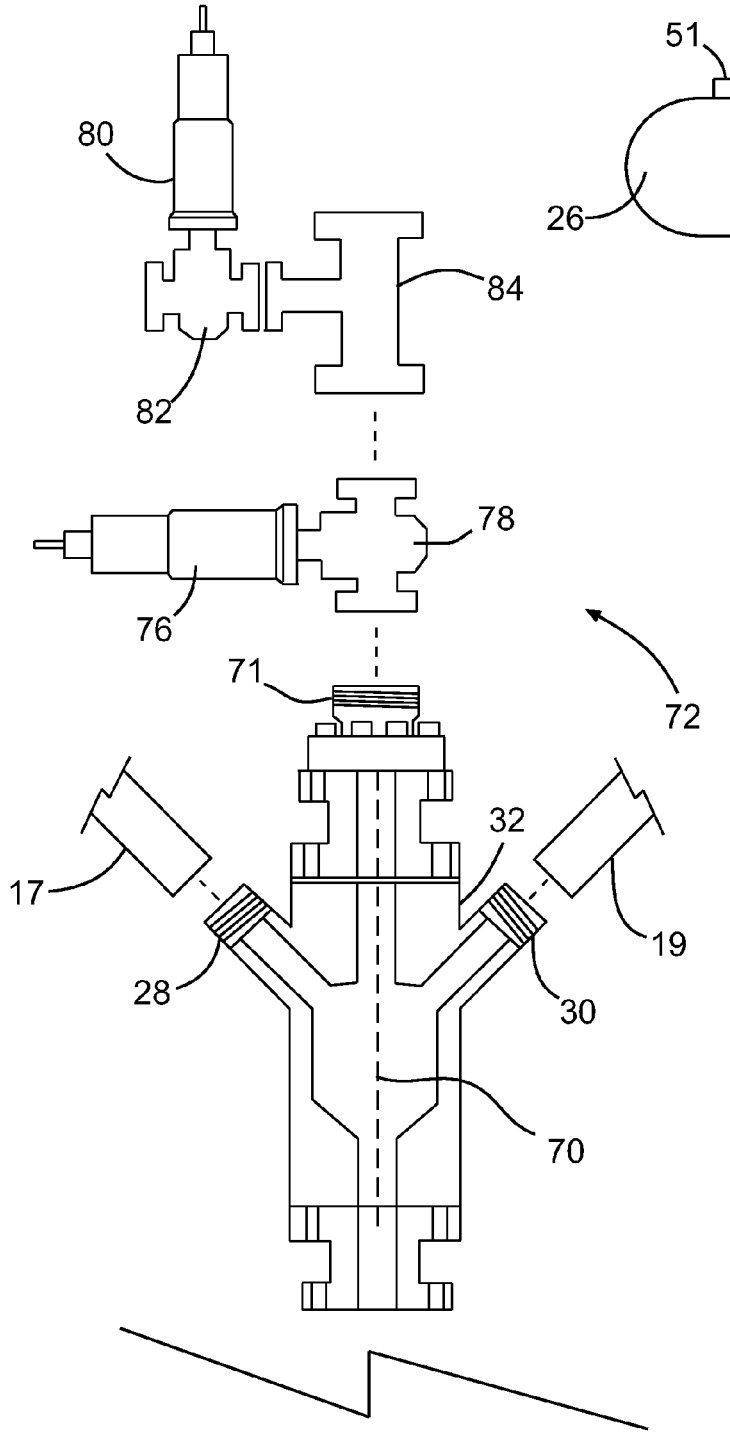
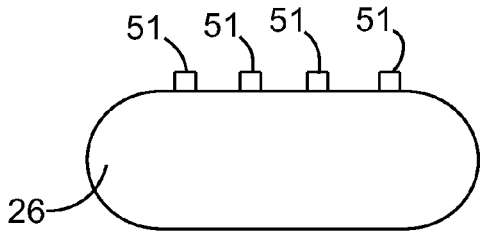
Fig. 4
Fig. 2
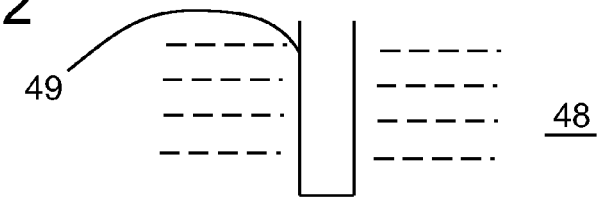

HYBRID LPG FRAC

CROSS-REFERENCE TO RELATED APPLICATIONS

This application claims the benefit under 35 USC 119(e) of U.S. provisional application Ser. No. 61/646,657 filed May 14, 2012, and of U.S. provisional application Ser. No. 61/780,813 filed Mar. 13, 2013.

TECHNICAL FIELD

This document relates to fracturing methods and apparatuses.

BACKGROUND

Split stream fracturing methods are disclosed in U.S. Pat. No. 3,842,910 (Zingg), U.S. Pat. No. 2,876,839 (Fast), U.S. Pat. No. 7,845,413 (Shampine), U.S. Pat. No. 7,341,103 (Taylor), and U.S. Pat. No. 5,899,272 (Loree) and US publication no. 20090301719 (Bull). Such methods combine a proppant stream and a fracturing fluid stream after pumping both streams with frac pressure pumps but before the streams enter the wellhead, including at or near the wellhead, and it is known from these and other references to use liquefied petroleum gas (LPG) as a fracturing fluid.

SUMMARY

A fracturing method is disclosed comprising: pumping a first stream of liquefied petroleum gas and gelling agent with a first frac pressure pump; pumping a second stream of lubricated proppant with a second frac pressure pump; combining the first stream and the second stream within a wellhead into a combined stream; pumping the combined stream into a hydrocarbon reservoir; and subjecting the combined stream in the hydrocarbon reservoir to fracturing pressures.

A fracturing apparatus is disclosed comprising: a first frac pressure pump connected to a first port of a wellhead; a second frac pressure pump connected to a second port of the wellhead; a frac fluid source connected to supply a stream of frac fluid comprising liquefied petroleum gas to the first frac pressure pump; a gel source connected to supply a gelling agent into the frac fluid; and a proppant supply source connected to supply lubricated proppant to the second frac pressure pump.

A fracturing apparatus is disclosed comprising: a frac pressure pump connected to a wellhead; one or more storage tanks connected to supply a stream of frac fluid comprising liquefied petroleum gas to the frac pressure pump; and four or more safety valves on each of the one or more storage tanks.

A fracturing apparatus is disclosed comprising: a frac pressure pump connected to a wellhead; a frac fluid source connected to supply a stream of frac fluid comprising liquefied petroleum gas to the first frac pressure pump; a proppant supply source connected to supply proppant to the wellhead; and a proppant intensifier between the proppant supply source and the wellhead.

A fracturing method is disclosed comprising: determining a surface tension of reservoir hydrocarbons under reservoir conditions within a hydrocarbon reservoir; pumping a first stream of gelled liquefied petroleum gas with a first frac pressure pump; pumping a second stream of proppant and liquid hydrocarbons, which have seven or more carbons per hydrocarbon molecule, with a second frac pressure pump; combining the first stream and the second stream in a ratio selected to yield a combined stream that, under reservoir conditions, has a surface tension that matches or is less than, the surface tension of the reservoir hydrocarbons; pumping the combined stream into the hydrocarbon reservoir; and subjecting the combined stream in the hydrocarbon reservoir to fracturing pressures.

A well treatment method is disclosed comprising: providing a well treatment fluid made from at least a first starting material and a second starting material, the first starting material having liquefied petroleum gas with a purity of at least 0.95 mole fraction of the first starting material, and the second starting material having alkanes, with seven or more carbons per molecule, with a purity of at least 0.95 mole fraction of the second starting material; and pumping a stream of the treatment fluid into a hydrocarbon reservoir.

In various embodiments, there may be included any one or more of the following features: The first stream is pumped into a first port of the wellhead and the second stream is pumped into a second port of the wellhead. The lubricated proppant is lubricated with liquid. The liquid is ungelled. The liquid is gelled. The liquid is free of liquefied petroleum gas. The liquid comprises liquid hydrocarbons. The liquid hydrocarbons comprise seven or more carbons per hydrocarbon molecule. The liquid hydrocarbons comprise eighteen or less carbons per hydrocarbon molecule. The method comprises before, after, or before and after the second stream is pumped, pumping a treatment fluid with the second frac pressure pump to the wellhead. The treatment fluid comprises an acid spearhead. The treatment fluid has a higher density than the first stream, and the treatment fluid is pumped to provide a fluid cap over the combined stream in the hydrocarbon reservoir. The liquefied petroleum comprises hydrocarbons with four or more carbons per molecule in an amount of more than 50% by volume of the liquefied petroleum gas. The hydrocarbon reservoir comprises oil, injected fluids are flowed back from the hydrocarbon reservoir, and the flowback fluids are supplied to an oil sales line. Prior to supplying the flowback fluids to the oil sales line, the flowback fluids are diluted with reservoir oil from the hydrocarbon reservoir. A proppant intensifier is connected between the proppant supply source and the second port of the wellhead. The proppant intensifier is connected after the second frac pressure pump. A treatment fluid source is connected to supply treatment fluid to the second frac pressure pump. The safety valves each have a bore that is three inches or more in diameter. The first stream and second stream are combined in a ratio selected to yield a combined stream that, under reservoir conditions, has a surface tension that matches the surface tension of the reservoir hydrocarbons. Matches means the surface tensions of the combined stream and the reservoir hydrocarbons are within three dynes/cm of one another. Matches means the surface tensions of the combined stream and the reservoir hydrocarbons are within 1 dyne/cm of one another. A pad of liquefied petroleum gas is injected prior to combining the first stream and the second stream. The methods are well treatment methods. The stream is subjected in the hydrocarbon reservoir to fracturing pressures. The first starting material has liquefied petroleum gas with a purity of at least 0.99 mole fraction of the first starting material, and the second starting material has alkanes, with seven or more carbons per molecule, with a purity of at least 0.99 mole fraction of the second starting material. The well treatment fluid has less than 0.01 mole fraction combined of benzene, toluene, ethylbenzene,and xylenes. The well treatment fluid has less than 0.01 mole fraction of polynuclear aromatic hydrocarbons. The well treatment fluid has less than 100 ppm by weight combined of sulphur and oxygenates.

These and other aspects of the device and method are set out in the claims, which are incorporated here by reference.

BRIEF DESCRIPTION OF THE FIGURES

Embodiments will now be described with reference to the figures, which are not drawn to scale, in which like reference characters denote like elements, by way of example, and in which:

FIG. 2 is a side elevation projected view, partially in section, of a multi port wellhead, a fracturing fluid stream line, a proppant stream line, and various ball drop components.

FIG. 4 is a side elevation view of an LPG storage tank with four or more safety valves.

DETAILED DESCRIPTION

Immaterial modifications may be made to the embodiments described here without departing from what is covered by the claims.

In the conventional fracturing of wells, producing formations, new wells or low producing wells that have been taken out of production, a formation can be fractured to attempt to achieve higher production rates. Proppant and fracturing fluid are mixed in a blender and then pumped into a well that penetrates an oil or gas bearing formation. Various chemicals may be added to the fracturing fluid, such as gelling agents, breakers, activators, and surfactants. High pressure is applied to the well, the formation fractures and proppant carried by the fracturing fluid flows into the fractures. The proppant in the fractures holds the fractures open after pressure is relaxed and production is resumed.

Figure 3A:
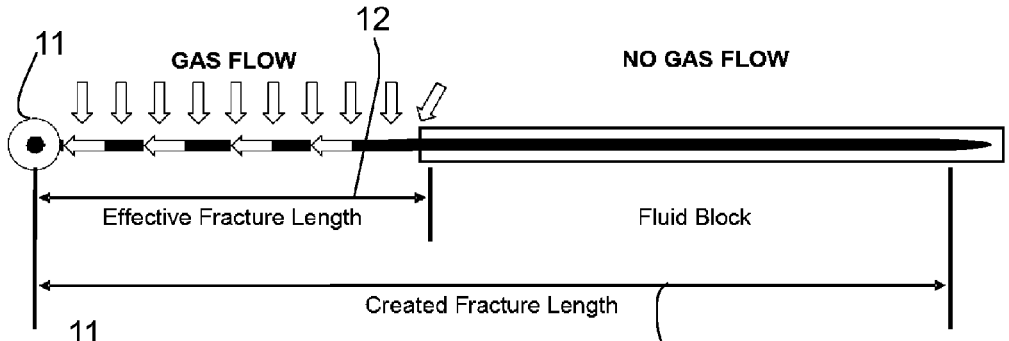
FIGS. 3A-B are schematics of a fracture created by conventional fracturing fluids such as oil or water.
Figure 3B:
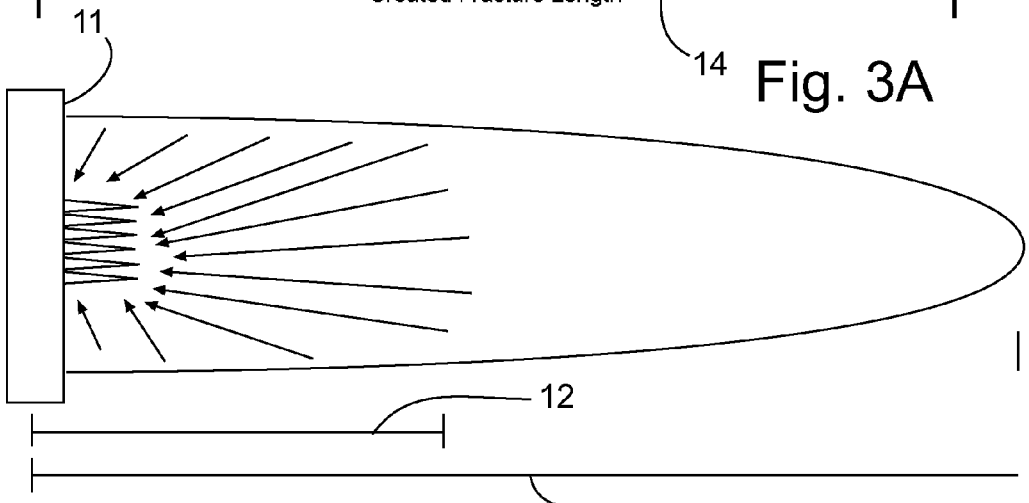

Conventional fracturing fluids include water, frac oil, methanol, and others. However, these fluids are difficult to recover from the formation, with 50% of such fluids typically remaining in a formation after fracturing. Referring to FIGS. 3A-B, these fluids are also limited to a relatively short maximum effective frac length 12, irrespective of the length of the created fracture 14 actually formed. Effective frac length 12 refers to the extent of the created fracture 14 through which well fluids may be produced into the well 11.

Various alternative fluids have been disclosed for use as fracturing fluids, including liquefied petroleum gas (LPG), which has been advantageously used as a fracturing fluid to simplify the recovery and clean-up of frac fluids after a frac. Exemplary LPG frac systems are disclosed in WO2007098606 and U.S. Pat. No. 3,368,627. However, LPG has not seen widespread commercial usage in the industry, and conventional frac fluids such as water and frac oils continue to see extensive use.

LPG may include a variety of petroleum and natural gases existing in a liquid state at ambient temperatures and moderate pressures. In some cases, LPG refers to a mixture of such fluids. These mixes are generally more affordable and easier to obtain than any one individual LPG, since they are hard to separate and purify individually. Unlike conventional hydrocarbon based fracturing fluids, common LPGs are tightly fractionated products resulting in a high degree of purity and very predictable performance. Exemplary LPGs include propane, butane, or various mixtures thereof As well, exemplary LPGs also include isomers of propane and butane, such as iso-butane. Further LPG examples include HD-5 propane, commercial butane, and n-butane. The LPG mixture may be controlled to gain the desired hydraulic fracturing and clean-up performance. LPG fluids used may also include minor amounts of pentane (such as i-pentane or n-pentane), higher weight hydrocarbons, and lower weight hydrocarbons such as ethane.

LPGs tend to produce excellent fracturing fluids. LPG is compatible with formations, such as oil or gas reservoirs, and formation fluids, and is highly soluble in formation hydrocarbons and eliminates phase trapping—resulting in increased well production. LPG may be readily viscosified to generate a fluid capable of efficient fracture creation and excellent proppant transport. After fracturing, LPG may be recovered very rapidly, allowing savings on clean up costs. In some embodiments, LPG may be predominantly propane, butane, or a mixture of propane and butane. In some embodiments, LPG may comprise more than 80%, 90%, or 95% propane, butane, or a mixture of propane and butane. The LPG may comprise Y grade LPG.

Figure 1:
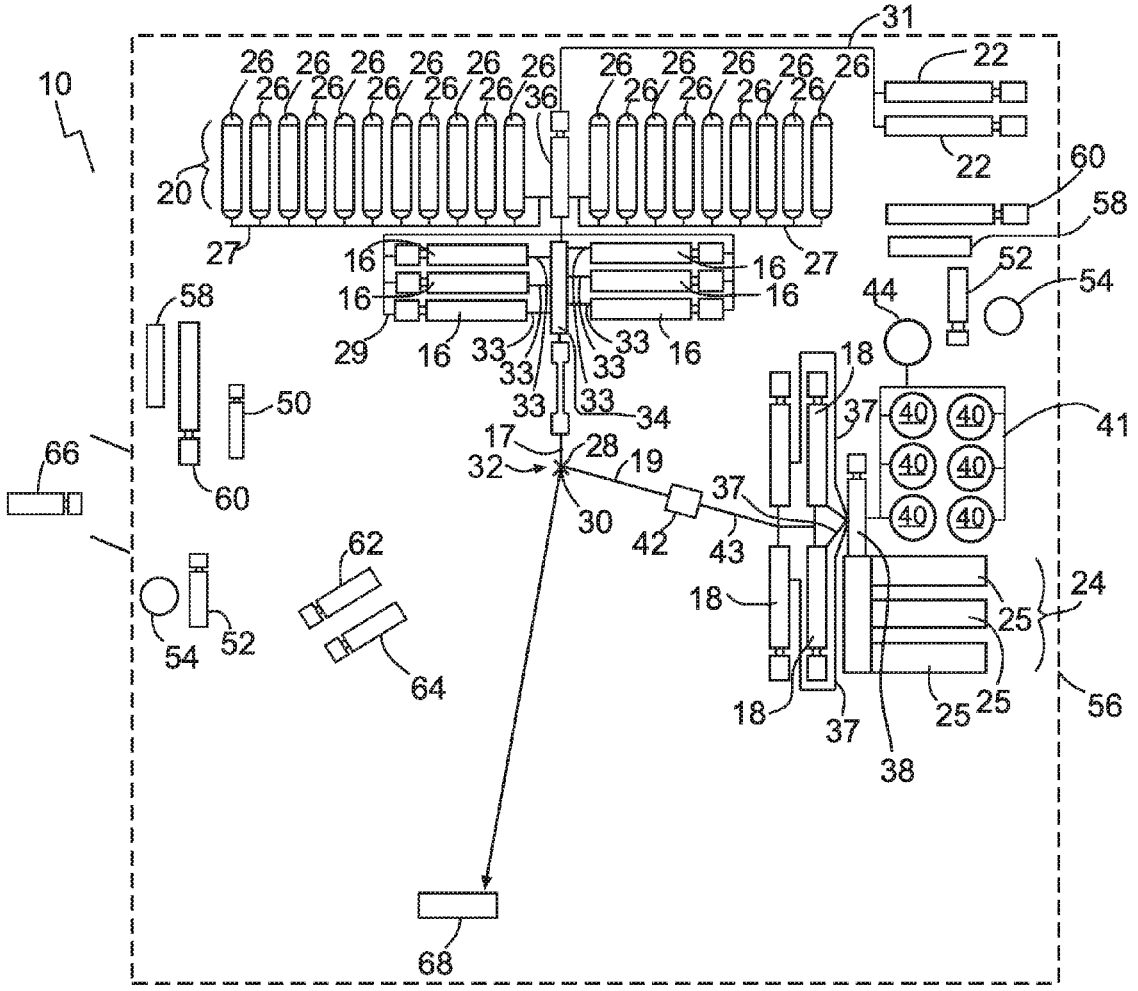
FIG. 1 is a schematic of an apparatus for carrying out a fracturing method according to the embodiments disclosed herein.

Referring to FIGS. 1 and 2, a fracturing apparatus 10 is illustrated. Apparatus 10 comprises one or more frac pressure pumps, for example a first frac pressure pump 16 and a second frac pressure pump 18, and a frac fluid source 20 such as one or more LPG storage tanks 26 (FIG. 1). Apparatus 10 may comprise a gel source 22 and a proppant supply source 24.

As shown in FIG. 1, more than one of each pumps 16 and 18 may be provided, for example in series, parallel, or in series and parallel pumping arrangement. First frac pressure pump 16 may be connected by line 17 to a first port or ports 28 of a wellhead 32, and second frac pressure pump 18 may be connected by lines 43 and 19 to a second port or ports 30 of wellhead 32 (FIGS. 1 and 2). Frac pressure pumps 16, 18 may each be pumps suitable for pumping fluid at fracturing pressures, for example over 1000 psi, and may be positive displacement pumps such as triplex, quaduplex, or quintuplex pumps.

Frac fluid source 20 may be connected to supply, for example from storage tanks 26 through lines 27 and 29, a first stream of frac fluid comprising LPG to the first frac pressure pump 16. An LPG storage tank or bulker includes a bulk carrier for example an LPG tanker truck. LPG may pass through one or more boost pumps 36 en route to the frac pressure pump 16, for example for raising the pumping pressure of the LPG as needed in environments with high ambient temperatures such as those seen in Texas. After being pressurized sufficiently within pumps 16, the frac fluid may be passed through lines 33 into one or more manifolds 34, then through line 17 into wellhead 32. The first stream may also pass through a blender.

Referring to FIG. 4, there may be four or more safety valves 51 on each of the one or more storage tanks 26. The safety valves 51 may each have a bore that is three inches or more in diameter. The use of four or more safety valves 51 provides an adequate flow rate out of a storage tank 26 that may not be possible with the standard supply of one to two safety valves currently used on existing storage tanks 26.

Referring to FIG. 1, gel source 22 may be connected through line 31 to supply a gelling agent into the frac fluid. The gelling agent assists carriage of proppant into the hydrocarbon reservoir 10. The gelling agent may be any gelling agent suitable for gelling the LPG frac fluid, and may be required to carry a sufficient amount of proppant. Other chemicals such as activators and breakers may be added. Each chemical or agent to be added, including gelling agent, may be added at a suitable respective point in the stream of frac fluid, for example before (FIG. 1 for the gelling agent), at, or after the frac pressure pumps 16.

Proppant supply source 24, for example one or more sand storage tanks 25, may be connected through lines 37 to supply lubricated proppant to the second frac pressure pumps 18. A proppant addition truck 38 may be provided for transferring the proppant, such as sand, to the pumps 18. Truck 38 may also receive lubricant, such as liquid from one or more liquid supply sources 40 through line 41, to blend with proppant before passing through pumps 18. Blending may occur within truck 38. Suitable proppant may be used, including different types of proppant.

A proppant intensifier 42 may be connected, for example after frac pump 18 along line 43, between the proppant supply source 24 and the second port 30 of the wellhead 32. A proppant intensifier, also called an enhancer, concentrates proppant by removing excess fluid from the stream. Excess fluid may be diverted back to sand tanks 25 or another suitable reservoir. Proppant intensifier 42 may include a centrifuge (not shown).

Figure 6:
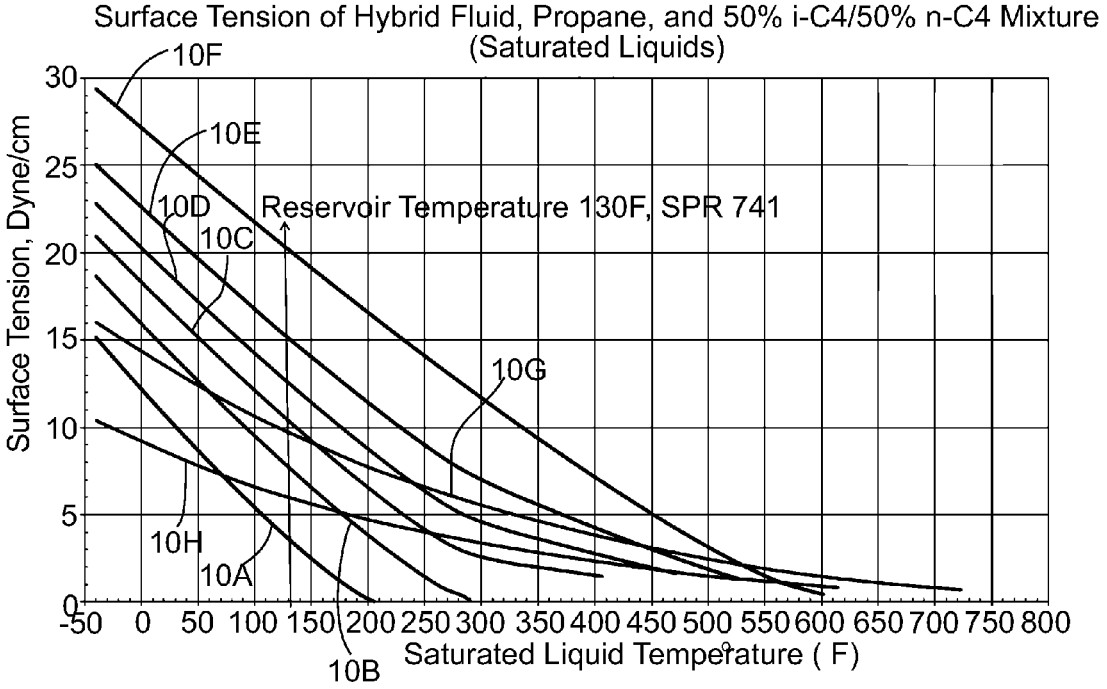
FIG. 6 is a graph of surface tension versus liquid temperature for various reservoir fluids and fracturing fluids.
Figure 7:
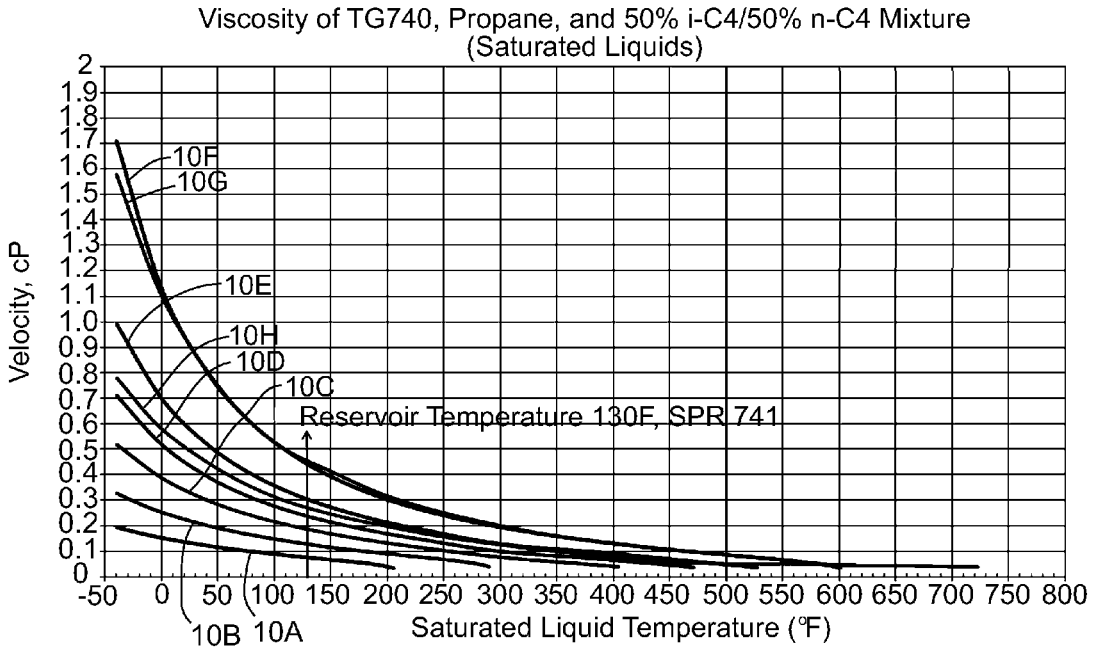
FIG. 7 is a graph of viscosity versus liquid temperature for various reservoir fluids and fracturing fluids.
Figure 8:
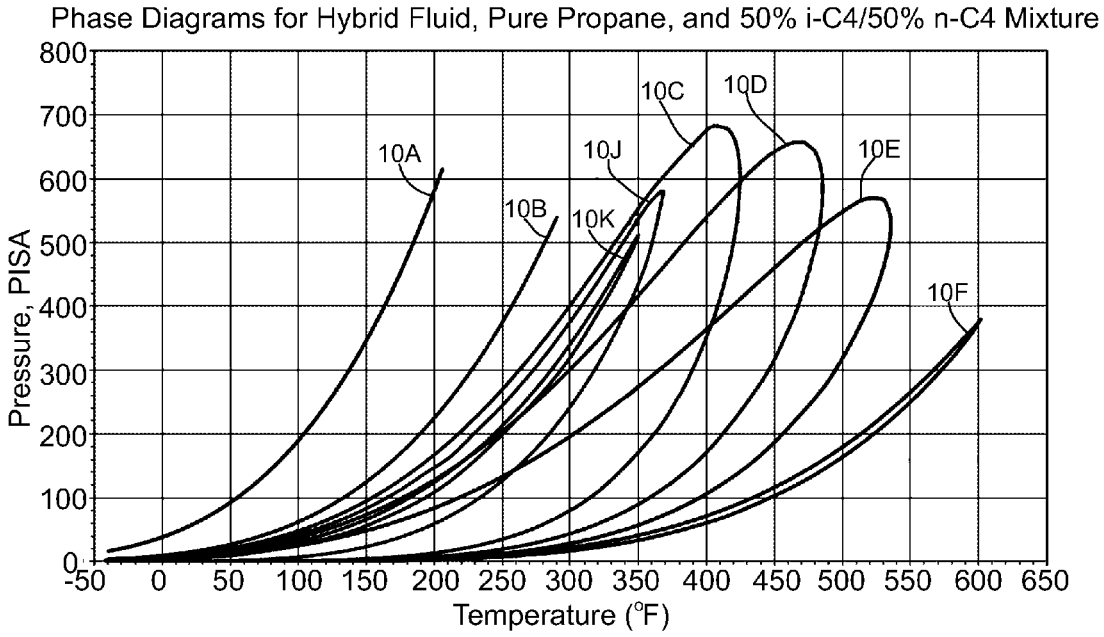
FIG. 8 is a phase diagram of pressure versus temperature for various fracturing fluids.

The liquid may be ungelled, so that no gelled proppant mixture passes through pumps 18. The liquid may be free of LPG. The liquid may comprise liquid hydrocarbons, such as liquid hydrocarbons comprising seven or more carbons per hydrocarbon molecule, for example between seven and eighteen carbons per hydrocarbon molecule. Hydrocarbons heavier than LPG are less volatile than LPG, and may allow atmospheric or low pressure addition into proppant. For example, C7-18 hydrocarbons may be used as the liquid. In some cases dry lubricant is used, or the proppant may be surface treated to be self-lubricated. The fluid listed as "Hybrid Fluid" in FIGS. 6-8 is a mixture of 0.81 mole fraction C7-C11 alkanes with 0.16 mole fraction aromatics.

One or more treatment fluid sources 44 may be connected to supply treatment fluid to the second frac pressure pump 18. The treatment fluid source 44 may be connected to supply treatment fluid through the proppant truck 38, or may be connected to the stream of lubricated proppant at a suitable point to reduce the need for redundant lines and other transfer equipment required to introduce a treatment fluid into the frac program. Such a setup is also beneficial because secondary treatment fluids can be added into the frac program without affecting or requiring modification of the LPG injection portion of the apparatus 10. It is advantageous to simplify the LPG injection portion of apparatus 10 because this reduces the chance of the creation of a dangerous situation, such as the situation that may result from an incorrect or faulty piping connection.

The treatment fluid may comprise an acid spearhead, for example to be injected into the formation before the frac begins and before proppant is pumped in. Other treatment fluids and associated programs may be used, such as a fluid for example crude oil that has a higher density than the frac fluid stream. Such a higher density fluid may be pumped to provide a fluid cap over the combined stream in the hydrocarbon reservoir, for example after the frac has been carried out but before shut in. A fluid cap provides additional hydrostatic pressure and assists in breaking down the formation. A higher density fluid may also be used as a well head blanket or spacer between surface equipment and the LPG in the well bore. In general, treatment fluid may be pumped before, after, during, or before and after the lubricated proppant stream is pumped, as desired.

Figure 2B:
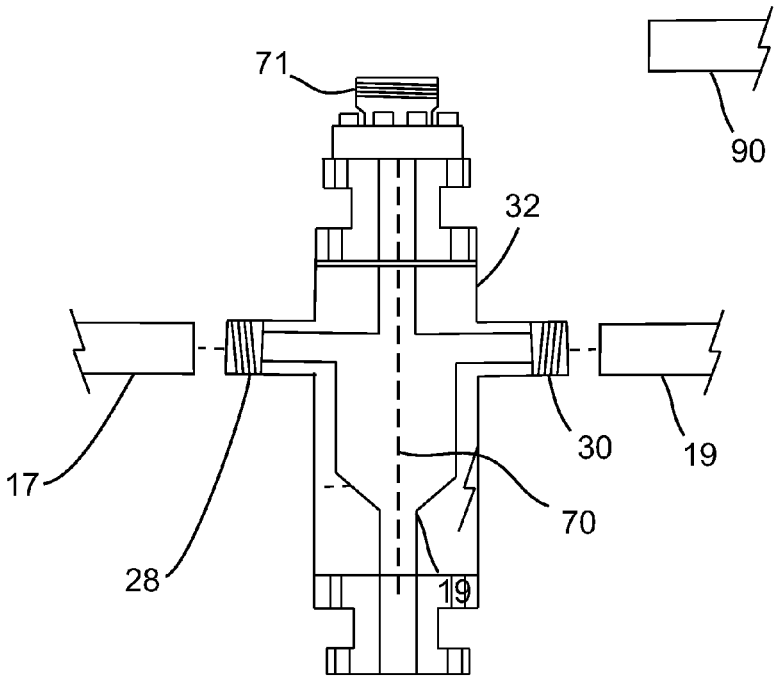
FIG. 2B is a side elevation projected view, partially in section, of a multi port wellhead, a fracturing fluid stream line, a proppant stream line, and various ball drop components.

Referring to FIG. 2, an exemplary wellhead 32 setup is illustrated. Wellhead 32 may be a suitable wellhead such as a multi-port wellhead as shown. A wellhead is understood to include the part of the well 49 that extends from the ground, for example vertically or at an angle. Wellhead 32 has two or more ports, such as ports 28 and 30 as shown, extending laterally from wellhead 32. Ports 28 and 30 may have suitable connections to lines 17 and 19, for example if ports 28 and 30 are female hammer unions. Ports 28 and 30 may be oriented at a suitable angle relative to a wellhead axis 70, including a forty five degree angle (shown) or a perpendicular angle in some cases. The wellhead 32 may have a suitable connection at a top port 71, for example another female hammer union, for ball dropping equipment 72, for example used with horizontal wells. A first hydraulic valve 76 may be used to isolate for ball drops, for example by connection to top port 71 through a pump in sub 78. A second hydraulic valve 80 may be used to flush the ball during dropping, and may be connected to pump in sub 78 through a second pump in sub 82 and a suitable connector 84 as shown. Other arrangements are possible, such as the T-shaped wellhead 32 shown in FIG. 2B.

Apparatus 10 may incorporate various other components shown or not shown, as is required or desired. For example, one or more fire trucks 52 and corresponding fire extinguishing fluid reservoirs 54 may be located at various locations about a frac site 56. Reservoirs 54 may contain water or other suitable fluids. One or more inert fluid sources, such as a nitrogen storage tank 58 and a nitrogen vaporizer unit 60 may be provided for supplying inert gas to system components. In one embodiment, inert gas is supplied to LPG storage tanks 26 to supply a gas blanket over LPG fluid. A command center truck 50, an iron truck 62, a wellhead truck 64, a safety truck 66, and third party testing equipment 68 are other examples of additional components shown in FIG. 1. Other components that may be used include, but are not limited to a flush pump, a flameless nitrogen pump, and a chemical transfer unit. Although inert fluid is described above as nitrogen, other suitable fluids may be used such as argon. An inert gas should be sufficiently non-reactive as to be useful for fire prevention and suppression.

A fracturing method may be carried out using the apparatus 10 as follows. A first stream of LPG and gelling agent may be pumped with first frac pressure pump 16. A second stream of lubricated proppant may be pumped with second frac pressure pump 18. The first stream and the second stream are combined within wellhead 32 into a combined stream (FIG. 2). In some cases the ratio by volume of the first stream to the second stream is between 9:1 and 1:9, although other ratios may be used. The combined stream is pumped into a hydrocarbon reservoir 48, and the combined stream in the hydrocarbon reservoir is subjected to fracturing pressures using one or both of pumps 16 and 18. As described above, the method may include other steps such as supplying treatment fluid using second frac pressure pump 18, or as required. The method may be controlled using one or more controllers such as command center truck 50 (FIG. 1). Truck 50 may be connected wirelessly or by wired connection to control one or more or all of the operations of the frac components discussed herein.

The systems described herein can be produced by conversion of an existing system that supplies a gelled and proppant laden LPG fluid to a frac pump, with minimal modification to setup, operating procedures, and gel addition, and resulting in increased job size scope and safety. Job size may be increased by the fact that more than one 100 tonne proppant source may be used. In addition, such systems may allow easy separation of proppant types in sand scours, resin coated proppant tail-ins used for sand consolidation and addition of high strength proppants. The proppant may be lubricated with a minimal amount of non LPG liquid such as hybrid fluid, that is a fluid of predominantly C7-18, to allow the highest percentage of LPG in the down hole slurry. For example, for every 100 tonne of sand added only 60 $m^3$ of hybrid fluid may be added. Other proportions of liquid and LPG may be used. Moreover, pumping in a proppant pad lubricated with non LPG fluid and combined with LPG allows a fluid safety barrier in the proppant addition equipment, in addition to the check valves and remote shut off valves used in the system.

By combining lubricated proppant and gelled LPG within the wellhead 32, the speed of proppant laden fluid through surface lines can be reduced, for example to below 30 ft/sec. Thus, wear on surface lines is reduced and safety of the system is increased. In addition, hydraulic horse power used on either the proppant or LPG side can be backed up. The LPG pumps do not transport proppant laden fluid and hence these pumps can be stopped and started at will. Currently if an LPG pump is stopped with proppant in it the pump cannot be restarted until it is cleaned out. By contrast, a fluid pumper used for proppant addition is able under correct procedures to be started with sand laden fluid in the fluid end.

Tables 1A-B and 2A-B are statistics from exemplary procedures carried out with a 5 and 10 $m^3$/min down hole injection rate. Each of Tables 1A-1B and 2A-2B are to be read as if each part of the tables (A, B) was combined together side by side in landscape format. Each job begins with LPG at 95% by volume for the pad. Sand injection is started by injecting a slurry of oil and proppant at a surface concentration above 700 kg/$m^3$, which reduces sand settling to keep the sand suspended while pumping with little agitation. For the purpose of these examples a sand concentration of 1000 kg/$m^3$ was used on the surface concentration. As shown in the examples, the sand concentration was increased in 100 kg/$m^3$ increments at the perforations level. When the proppant perforation concentration is at 100 kg/$m^3$, LPG is at 90% by volume and surface concentration is at 1000 kg/$m^3$. As each job progresses the proppant concentration at the perforations level is increased by increasing the slurry rate & the surface sand concentration while at the same time reducing the LPG injection rate. At 600 kg/$m^3$ density the surface concentration is at 2000 kg/$m^3$ and 600 kg/$m^3$ densities can be achieved with 70% LPG by volume. If it is desired to raise the sand concentration at the perforations above what is shown, the % LPG by volume can be reduced. The difference between the two tables is the downhole injection rate.

TABLE 1A

Rate of 5 $m^3$/min and perforation concentrations of 100 to 600 kg/$m^3$

| LPG % By Vol | Prop Clean Stage M3 | Prop Clean Cumm M3 | LPG Clean Stage M3 | LPG Clean Cumm M3 | DH Clean Cumm M3 | DH Slurry Cumm M3 | Prop Surf Conc Kg/M3 | Prop Perf Conc Kg/M3 |
|---|---|---|---|---|---|---|---|---|
| 0.95 | 5 | 5 | 95 | 95 | 100 | 100 | 0 | |
| 0.90 | 5 | 10 | 45 | 140 | 150 | 152 | 1000 | 100 |
| 0.85 | 13 | 23 | 74 | 214 | 237 | 245 | 1333 | 200 |
| 0.75 | 13 | 36 | 39 | 253 | 289 | 305 | 1600 | 400 |
| 0.72 | 13 | 49 | 33 | 286 | 335 | 360 | 1786 | 500 |
| 0.70 | 17 | 66 | 40 | 326 | 392 | 430 | 2000 | 600 |
| 0.75 | 12 | 78 | 36 | 362 | 440 | 478 | 0 | |

TABLE 1B

Rate of 5 $m^3$/min and perforation concentrations of 100 to 600 kg/$m^3$

| LPG % By Vol | Rate Clean M3/Min | Rate Slurry M3/Min | Rate LPG M3/Min | Rate Down Hole M3/Min | Prop Stage Slurry M3 | Prop Slurry Cumm M3 | Prop Total Tonne | Sand Stage Tonne |
|---|---|---|---|---|---|---|---|---|
| 0.95 | 0.3 | 0.3 | 4.8 | 5.0 | 5.0 | 5.0 | 0 | 0 |
| 0.90 | 0.5 | 0.7 | 4.3 | 5.0 | 6.9 | 11.9 | 5 | 5 |
| 0.85 | 0.7 | 1.0 | 4.0 | 5.0 | 19.5 | 31.4 | 22 | 17 |
| 0.75 | 1.1 | 1.7 | 3.3 | 5.0 | 20.8 | 52.3 | 43 | 21 |
| 0.72 | 1.2 | 2.0 | 3.0 | 5.0 | 21.8 | 74.0 | 66 | 23 |
| 0.70 | 1.2 | 2.1 | 2.9 | 5.0 | 29.8 | 103.9 | 100 | 34 |
| 0.75 | 1.3 | 1.3 | 3.8 | 5.0 | 12.0 | 115.9 | 100 | 0 |

TABLE 2A

Rate of 10 $m^3$/min and perforation concentrations of 100 to 600 kg/$m^3$

| LPG % By Vol | Prop Clean Stage M3 | Prop Clean Cumm M3 | LPG Clean Stage M3 | LPG Clean Cumm M3 | DH Clean Cumm M3 | DH Slurry Cumm M3 | Prop Surf Conc Kg/M3 | Prop Perf Conc Kg/M3 |
|---|---|---|---|---|---|---|---|---|
| 0.95 | 5 | 5 | 95 | 95 | 100 | 100 | 0 | |
| 0.90 | 5 | 10 | 45 | 140 | 150 | 152 | 1000 | 100 |
| 0.85 | 13 | 23 | 74 | 214 | 237 | 245 | 1333 | 200 |
| 0.75 | 13 | 36 | 39 | 253 | 289 | 305 | 1600 | 400 |
| 0.72 | 13 | 49 | 33 | 286 | 335 | 360 | 1786 | 500 |
| 0.70 | 17 | 66 | 40 | 326 | 392 | 430 | 2000 | 600 |
| 0.75 | 12 | 78 | 36 | 362 | 440 | 478 | 0 | |

TABLE 2B

Rate of 10 $m^3$/min and perforation concentrations of 100 to 600 kg/$m^3$

| LPG % By Vol | Rate Clean M3/Min | Rate Slurry M3/Min | Rate LPG M3/Min | Rate Down Hole M3/Min | Prop Stage Slurry M3 | Prop Slurry Cumm M3 | Prop Total Tonne | Sand Stage Tonne |
|---|---|---|---|---|---|---|---|---|
| 0.95 | 0.5 | 0.5 | 9.5 | 10.0 | 5.0 | 5.0 | 0 | 0 |
| 0.90 | 1.0 | 1.3 | 8.7 | 10.0 | 6.9 | 11.9 | 5 | 5 |
| 0.85 | 1.4 | 2.1 | 7.9 | 10.0 | 19.5 | 31.4 | 22 | 17 |
| 0.75 | 2.2 | 3.5 | 6.5 | 10.0 | 20.8 | 52.3 | 43 | 21 |
| 0.72 | 2.4 | 3.9 | 6.1 | 10.0 | 21.8 | 74.0 | 66 | 23 |
| 0.70 | 2.4 | 4.3 | 5.7 | 10.0 | 29.8 | 103.9 | 100 | 34 |
| 0.75 | 2.5 | 2.5 | 7.5 | 10.0 | 12.0 | 115.9 | 100 | 0 |

In some cases, the LPG used has hydrocarbons with four or more carbons per molecule in an amount of more than 50% by volume of the LPG. In further embodiments, the LPG has butane in an amount of more than 50% by volume of the LPG. In some embodiments the LPG has a reduced propane content, for example if hydrocarbons with three or fewer carbons per molecule are present in an amount of less than 50% by volume of the LPG. Such LPG mixes have lower volatility and lower vapor pressure, and may result in several advantages discussed below.

Figure 5:
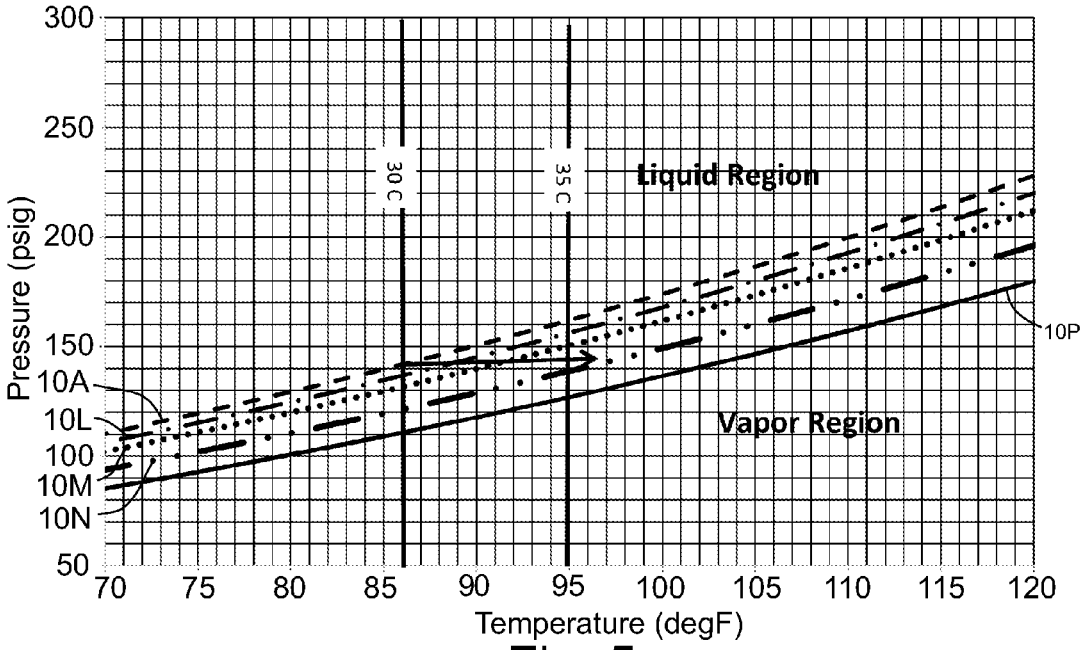
FIG. 5 is a phase diagram of pressure versus temperature for a variety of mixes of propane and butane.

Referring to FIG. 5, if the gas content or vapor pressure of the LPG is too high, excessive pressure variations may occur in the pumping equipment. Such variations may result in cavitation and damage to the pumping equipment leading to the possibility of an equipment failure and escape of volatile LPG. To reduce such effects, the temperature of the LPG being pumped may be monitored and maintained. As well, the gas content of the LPG may be determined and maintained within an acceptable range by selection of the LPG components. However, unexpected pressure variations may still occur. Reference characters in FIG. 5 are as follows: 100% propane 10A, 5% Butane/95% Propane=10L, 10% Butane/90% Propane=10M, 20% Butane/80% Propane=10N, 30% Butane/70% Propane=10P.

One unexpected source of pressure variations has been discovered to occur with fracturing operations carried out where the ambient temperature is relatively high, for example around 104° F. or higher, which can occur in locations such as Texas. Sand held in blenders at the well site for use as proppant in the fracturing operation may reach temperatures such as 149° F. due to the exposure of the blender to the sun. When sand and LPG are blended some of the LPG may change phase as shown in FIG. 5, resulting in production of an unexpected amount of gas and thus unexpected pressure variation during the fracturing operation.

To minimize such negative effects, liquid hydrocarbons with seven or more carbons per molecule may be used to carry proppant, and the LPG composition may be adjusted to reduce the vapor pressure. An example of the latter is achieved using higher proportions of butane, for example 50% or more butane by volume of the LPG. Pentane and hexane may also be used. By using a C4+ fluid, high pressure variation due to temperature may be reduced or eliminated while the C4+ fluid may still be pressurized using existing LPG fracturing equipment and known safety designs of the LPG fracturing equipment.

Flowback fluids may be processed or otherwise dealt with in various ways. In the case of a dry gas formation, LPG Propane may be recovered by comingled production in the gas sales line or recovered by an onsite LPG recovery unit using refrigeration with produced methane captured down the sales line. In the case of a liquid rich gas formation, LPG may be recovered by comingled production down a gas sales line to the customer facilities such as a Deep Cut facility. In the case of an oil formation, the LPG propane may be recovered by separation and comingled production down a gas sales line, or by an onsite LPG recovery unit using refrigeration with produced methane captured down the sales line usually requiring compression. The butane may be maintained within the oil sales line side.

The systems and methods disclosed herein may be adapted to reduce or eliminate on site processing, flaring, and other intervention of flowback fluids. Flowback after a fracturing or other well treatment disclosed here will contain LPG components and reservoir fluids. Processing methods that require flaring, gas sales lines, separation, or recovery units may be time consuming and may require additional capital and equipment. Thus, in some cases the hydrocarbon reservoir comprises oil and injected fluids are flowed back from the hydrocarbon reservoir and supplied to an oil sales line 90 (FIG. 2B). Higher proportions of butane or higher weight LPGs in the LPG injected into the well permit supply to an oil sales line, for example if the butane is produced from an oil bearing formation with the oil. Producing to an oil sales line may be advantageous because such a method reduces or removes the need to flare flow back gas, and allows the system to operate despite being at full capacity for handling flow back gas. Lower vapor pressure LPGs also reduce the need for sophisticated flow back equipment. To meet oil sales line requirements, the flowback fluid may be diluted with reservoir oil prior to supplying the flowback fluids to the oil sales line. Thus, preliminary flow back intervention may involve the C4 plus fracture fluid being diluted with existing oil production with pressurized flow back equipment until the C4 plus fracture fluid and reservoir fluid meet the pipeline requirements. Such processes may eliminate the requirements for a gas sales line, flaring, and or the requirements for onsite refrigeration.

The second stream may be designed to be a reduced hazard fluid as defined by the IRP-8 (INDUSTRY RECOMMENDED PRACTICE FOR THE CANADIAN OIL AND GAS INDUSTRY). IRP-8 considers a fluid to be a reduced hazard fluid if it is handled at temperatures at least 18° F. below the open cup flash point. Use of such a fluid allows atmospheric pressure delivery of proppant to the second stream. In some cases the second stream may have a Reid Vapor Pressure of less than 2 psi, and a flash point higher than ambient temperature, for example above 100° F.

In an exemplary fracturing operation, the fracturing fluid injected down hole is pumped at 50 bbl./min, comprising 25 bbl./min C4+, 12½ bbl./min sand and 12½ bbl./min mixture of C7-C18 alkanes. An exemplary C4+ fluid is plotted as 100% C4 in FIG. 8 and comprises isobutene 25 LV %, N-butane 30 LV %, iso-pentane 13 LV %, N-pentane 10 LV %, methyl and dimethyl pentanes 6 LV %, hexanes 7 LV % and the balance of various C3-C7 hydrocarbons that may be included with the product from the distillation tower. In some cases a mixture of isobutene and N butane can be used as a C4± fluid, for example the BB mix fluid plotted in FIG. 8. Tables 3A and 3B below illustrate an exemplary pumping schedule for a fracturing operation.

TABLE 3A exemplary pumping schedule for a fracturing operation

| | 22.1 | Proppant Specific Gravity English | | | 2.648 Down | Down | | |
|---|---|---|---|---|---|---|---|---|
| Proppant Absolute Density Lb/gal LPG % | Hybrid Clean Stage Bbl | Hybrid Clean Cum Bbl | LPG Clean Stage bbl | LPG Clean Cum bbl | Hole Clean Cum bbl | Hole Slurry Cum bbl | Hybrid Blender Conc lb/gal | Down Hole Conc lb/gal |
| 70.00% | 32.5 | 33 | 76 | 76 | 108 | 108 | 0.0 | |
| 70.00% | 128.6 | 161 | 300 | 376 | 537 | 537 | 0.0 | |
| 60.00% | 66.5 | 228 | 100 | 476 | 703 | 703 | 0.0 | |
| 62.70% | 88.8 | 316 | 149 | 625 | 941 | 952 | 2.7 | 1 |
| 65.40% | 82.5 | 399 | 156 | 781 | 1180 | 1212 | 5.8 | 2 |
| 68.20% | 81.9 | 481 | 176 | 957 | 1437 | 1505 | 9.4 | 3 |
| 70.90% | 7.5 | 488 | 18 | 975 | 1463 | 1535 | 13.7 | 4 |
| 70.00% | 23.6 | 512 | 55 | 1030 | 1542 | 1614 | 0.0 | |
| 70.00% | 7.5 | 519 | 18 | 1047 | 1567 | 1639 | 0.0 | |

TABLE 3B exemplary pumping schedule for a fracturing operation

| Hybrid Clean Rate bbl/min | Hybrid Slurry Rate bbl/min | Ratio Pump Group 2 | LPG Rate bbl/min | Down Hole Rate bbl/min | Hybrid Slurry Stage bbl | Hybrid Slurry Cum bbl | Proppant Total Cum lb | Send Stage Total lb |
|---|---|---|---|---|---|---|---|---|
| 4.5 | 4.5 | 0.300 | 10.5 | 15.0 | 33 | 33 | — | — |
| 15.0 | 15.0 | 0.300 | 35.0 | 50.0 | 129 | 161 | — | — |
| 20.0 | 20.0 | 0.400 | 30.0 | 50.0 | 67 | 228 | — | — |
| 17.8 | 20.0 | 0.400 | 30.0 | 50.0 | 100 | 327 | 9,999 | 9,999 |
| 15.9 | 20.0 | 0.400 | 30.0 | 50.0 | 104 | 431 | 30,028 | 20,029 |
| 14.0 | 20.0 | 0.400 | 30.0 | 50.0 | 117 | 548 | 62,479 | 32,451 |
| 12.3 | 20.0 | 0.400 | 30.0 | 50.0 | 12 | 560 | 66,820 | 4,341 |
| 15.0 | 15.0 | 0.300 | 35.0 | 50.0 | 24 | 584 | 66,820 | — |
| 4.5 | 4.5 | 0.300 | 10.5 | 15.0 | 8 | 591 | 66,820 | — |

In some methods a surface tension of reservoir hydrocarbons under reservoir conditions within a hydrocarbon reservoir may be determined. The first stream and second stream may be pumped and combined, before or within the wellhead, in a ratio selected to yield a combined stream that, under reservoir conditions, has a surface tension that matches or is less than, the surface tension of the reservoir hydrocarbons. Matching or minimizing the surface tension of injected fluids with the reservoir hydrocarbons results in an efficient deign that may maximize production. In addition, matching or minimizing the surface tension between the fracturing fluid and the reservoir may result in increased effective fracture length and increased production.

Referring to FIG. 6, an example surface tension plot illustrates how a fracturing fluid may be chosen for a reservoir. In the case shown the reservoir conditions include a temperature of 130° F. The oil rim phase shown refers to the reservoir hydrocarbons located in the part of the reservoir targeted for injection. The reservoir fluid refers to the surface tension of reservoir fluids containing dissolved gases and present in other areas of the reservoir. By contrast, the oil rim phase has reduced or no dissolved gases, and thus has a higher surface tension. Based on the model shown, a combined stream with a 70% LPG 30% C7-18 ratio by volume may be selected as the closest match for the reservoir oil. Matching may mean that the surface tensions of the combined stream and the reservoir hydrocarbons are within three dynes/cm, for example within 1 dyne/cm as shown, of one another. Reference characters in FIGS. 6 and 7 are as follows: propane 10A 50% i-C4/50% n-C4=10B, 30% Hybrid Fluid/70% C4=10C, 50% Hybrid Fluid/50% C4=10D, 70% Hybrid Fluid/30% C4=10E, 100% Hybrid Fluid=10F, Oil Rim Phase=10G, and Reservoir fluid=10H.

In some cases a constant ratio of stream 1 (LPG) to stream 2 (C7 plus) may be used to achieve surface tension optimization. In other cases surface tension may vary throughout treatment. For example a method may minimize surface tension of the fracture fluid at the tip or leading edge of the created hydraulic fracture geometry by injecting a pad of gelled or ungelled LPG prior to combining the streams. Upon cleanup the tip of the fracture or leading edge of the hydraulic fracture geometry will experience minimal differential pressure to overcome the threshold pressure required to move the fracture fluid. Thus, lower surface tension in such initial fluids may assist recovery. The highest LPG % may be present at the start of the pumping schedule as described in Tables 3A-B above. As shown in FIG. 6, the higher the LPG % in the fracture fluid the lower the surface tension of the fracture fluid. The high ratio of LPG at the start of the pumping schedule may allow the LPG upon cleanup to be easily mobilized and create a miscellable sweep as the LPG flowback approaches the wellbore. In addition, the LPG % percentage may be reduced towards the end of the pumping schedule to enhance the design requirements of increased down hole concentration. Reducing the LPG % at later points is not expected to cause reduced efficiency as later injected fluids are subject to larger pressure drops on flowback as such are in closest relative proximity to the wellbore. Thus, in some cases the average surface tension of injected fluids matches or is less than the reservoir hydrocarbon surface tension.

Referring to FIG. 7, in some cases the fracturing fluid is selected such that the viscosity before chemicals is matched to or less than the viscosity of the formation fluid. Thus, in the example shown all of the fracturing fluids plotted are suitable for injection into the oil rim phase, and fluids with at most 70% Hybrid Fluid and balance LPG are suitable for injection into the reservoir fluid.

The two fluids streams may be gelled together with one chemical system, for example the same gelling agent. In some embodiments both the liquid hydrocarbon stream and LPG stream are gelled before being combined.

Referring to FIG. 8, the combined streams and ratio of streams may be designed to create a combined stream with a critical temperature that is higher than the reservoir temperature, with the fracture fluid maintained in a liquid phase that may be gelled with LPG gelling chemistry. Reference characters in FIG. 8 is as follows: 100% propane 10A, 50% i-C4/50% n-C4=10B, 30% Hybrid Fluid/70% C4=10C, 50% Hybrid Fluid/50% C4=10D, 70% Hybrid Fluid/30% C4=10E 100% Hybrid Fluid=10F, 100% C4=10J, BB Mix=10K.

In some cases the fluids in both streams are clean, for example clean of BTEX. In some cases, the LPG used as a first starting material for the well treatment fluid has LPG with a purity of at least 0.95 mole fraction of the first starting material. In addition, the hydrocarbons used as a second starting material have alkanes, with seven or more carbons per molecule, at a purity of at least 0.95 mole fraction of the second starting material. The alkanes may be mineral oil. By ensuring the clean nature of starting materials used to form the individual fracturing fluid streams, the resulting fracturing fluid is itself clean or relatively cleaner than comparable dirty fluids. An exemplary C7-C18 fracturing fluid that may be used has about 0.96 mole fraction C7-18 alkanes and only about 0.04 mole fraction BTEX and aromatics combined. The purity level may be increased to 0.99 mole fraction and higher for both starting materials.

In some cases the combined well treatment fluid may have less than 0.01 mole fraction combined of benzene, toluene, ethylbenzene, and xylenes, collectively known as BTEX compounds. BTEX compounds have been discovered to be mobile in groundwater and responsible for various health disorders. Similarly, the combined well treatment fluid may have less than 0.01 mole fraction of polynuclear aromatic hydrocarbons such as naphthalene. The well treatment fluid may also have less than 100 ppm by weight combined of sulphur and oxygenate species.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A fracturing method comprising:

pumping a first stream of proppant-free liquefied petroleum gas and gelling agent with a first frac pressure pump through a first surface line into a wellhead through a first port of the wellhead;

pumping a second stream of lubricated proppant with a second frac pressure pump through a second surface line separate from the first surface line into the wellhead through a second port of the wellhead that is separate from the first port of the wellhead;

removing fluid from the second stream of lubricated proppant with a proppant intensifier prior to the second stream entering the second port of the wellhead, wherein the proppant intensifier removes fluid from the second stream after the second frac pressure pump;

the first stream and the second stream having respective velocity vector components that are directly opposite to each other both (a) upon exiting the first port and the second port, respectively, and (b) up to a point within the wellhead where the first stream and the second stream meet, thereby combining the first stream and the second stream within the wellhead into a combined stream;

pumping the combined stream into a hydrocarbon reservoir;

pumping a treatment fluid comprising an acid spearhead with the second frac pressure pump into the wellhead, wherein the treatment fluid has a higher density than the first stream, and the treatment fluid is pumped to provide a fluid cap over the combined stream in the hydrocarbon reservoir; and subjecting the combined stream in the hydrocarbon reservoir to fracturing pressures.

2. The fracturing method of claim 1 in which the lubricated proppant is lubricated with liquid.

3. The fracturing method of claim 2 in which the liquid is ungelled.

4. The fracturing method of claim 2 in which the liquid is gelled.

5. The fracturing method of claim 2 in which the liquid is free of liquefied petroleum gas.

6. The fracturing method of claim 2 in which the liquid comprises liquid hydrocarbons.

7. The fracturing method of claim 6 in which the liquid hydrocarbons comprise seven or more carbons per hydrocarbon molecule.

8. The fracturing method of claim 7 in which the liquid hydrocarbons comprise eighteen or less carbons per hydrocarbon molecule.

9. The fracturing method of claim 1 in which the liquefied petroleum gas further comprises hydrocarbons with four or more carbons per molecule in an amount of more than 50% by volume of the liquefied petroleum gas.

10. The fracturing method of claim 9 in which the hydrocarbon reservoir comprises oil and further comprising:

flowing back injected fluids from the hydrocarbon reservoir; and supplying the flowback fluids to an oil sales line.

11. The fracturing method of claim 10 further comprising, prior to supplying the flowback fluids to the oil sales line, diluting the flowback fluids with reservoir oil from the hydrocarbon reservoir.

12. The fracturing method of claim 1 in which the liquefied petroleum gas further consists essentially of propane, butane, or propane and butane.

13. The fracturing method of claim 1 in which the first port, the second port, and a wellhead axis form a Y-shape.

14. The fracturing method of claim 1 in which the first port, the second port, and a wellhead axis form a T-shape.

* * * * *